US006325359B1

(12) United States Patent
Haga et al.

(10) Patent No.: US 6,325,359 B1
(45) Date of Patent: Dec. 4, 2001

(54) DEVICE AND METHOD FOR PRODUCING GAS SOLUTION AND CLEANING DEVICE

(75) Inventors: Nobuaki Haga; Kenichi Mitsumori; Yasuhiko Kasama, all of Tokyo (JP)

(73) Assignee: Organo Corporation, Tokyo (JP)

( * ) Notice: Subject to any disclaimer, the term of this patent is extended or adjusted under 35 U.S.C. 154(b) by 0 days.

(21) Appl. No.: 09/608,583

(22) Filed: Jun. 30, 2000

(30) Foreign Application Priority Data

Jul. 5, 1999 (JP) ..... 11-190998

(51) Int. Cl.[7] ..... B01F 3/04

(52) U.S. Cl. ..... 261/42; 261/62; 261/64.1; 261/105; 261/DIG. 42

(58) Field of Search ..... 261/42, 62, 64.1, 261/38, 102, 105, DIG. 42; 210/760

(56) References Cited

U.S. PATENT DOCUMENTS 3,740,041 * 6/1973 Jones ..... 261/64.1
4,369,115 * 1/1983 Bauer ..... 261/64.1
4,497,749 * 2/1985 Strauss ..... 261/62
5,971,368 * 10/1999 Nelson et al. ..... 261/DIG. 42

* cited by examiner

*Primary Examiner*—C. Scott Bushey
(74) *Attorney, Agent, or Firm*—Rosenthal & Osha LLP

(57) ABSTRACT

A gas solution producing device having a simple structure to reduce a start-up time, and capable of reducing an amount of gas or solution for use, and a method therefor, as well as a cleaning device employing them. An ozone water solution producing device of the present invention includes a gas dissolving module for bringing ozone gas and deionized water in contact with each other for production of ozone solution, a gas introducing pipe for introducing ozone gas from an ozone gas producing device to the gas dissolving module, a buffer, connected on the gas introducing pipe, for temporarily storing ozone gas and thereafter discharging the gas stored to the gas introducing pipe, a first valve for opening or closing the gas introducing pipe to switch introduction and suspension of gas flow to the gas dissolving module, and backflow prevention valve for preventing a backflow of the gas discharged from the buffer.

12 Claims, 13 Drawing Sheets

DEVICE AND METHOD FOR PRODUCING GAS SOLUTION AND CLEANING DEVICE

BACKGROUND OF THE INVENTION

1. Field of the Invention

The present invention relates to a device and method for producing gas solution, such as hydrogen solution, ozone solution, or the like, for preferable use in cleaning of substrates or the like used in production of electronic components and other such devices, and also to a cleaning device employing the gas solution producing device.

2. Description of the Related Art

In the field of electronic devices (semiconductor devices, LCD panels, and so on), a step of cleaning substrates (semiconductor or glass substrates, and so on) is included in all production process. During cleaning, foreign objects, including organic material (e.g., particles, photoresists, and so on) in the atmosphere in a clean room, which have become attached to the substrates must be removed. There is therefore great interest in cleaning solutions superior in cleaning performance and preferable for use in such cleaning. Some candidates of such solution are ozone solution and hydrogen solution, and so on, which can be obtained by dissolving gas (ozone, hydrogen, and so on) in deionized water. As a method for dissolving these gases into deionized water, a method for bringing gas into contact with deionized water via hollow fiber membrane is well known conventionally.

FIG. 13 is a diagram showing a conventional ozone solution producing device 90. The ozone solution producing device 90 mainly comprises an ozone producing device 91 and a gas dissolving module 92. The gas dissolving module 92 is, for example, a cylinder vessel accommodating a number of hollow fiber membranes, and supplied with ozone gas produced in the ozone producing device 91, as well as deionized water. When ozone gas and deionized water are introduced into the gas dissolving module 92, the ozone gas flows into each hollow fiber membrane, while the deionized water fills interior space of the vessel. Then, when the ozone gas and deionized water come into contact with each other via the hollow fiber membranes, the ozone gas is dissolved into the deionized water and an ozone solution consisting of ozone dissolved in deionized water is produced. The resultant ozone solution is supplied to, for example, a nozzle 93 of a cleaning device, for use in cleaning.

The above-mentioned conventional ozone solution producing device, however, has the following shortcomings. The conventional electrolytic ozone producing device for general use is constructed, for protection of the electrodes, such that ozone production cannot be suspended. Moreover, as the starting up of a gas dissolving module requires a relatively longer period of time, ozone production must be continued to ensure stable ozone concentration. Thus, there is no choice but to discard unused ozone solution. In addition, as the ozone producing device and the gas dissolving module are directly connected to each other via a pipe, ozone gas is always supplied to the gas dissolving module whether or not ozone solution is used. In other words, while ozone solution is not used, ozone gas is wastefully thrown away. This results in a very inefficient device.

In order to improve the efficiency of such equipment, there has been proposed a structure in which a valve is provided in a pipe connecting the ozone producing device and the gas dissolving module. With this structure, the valve is closed while ozone solution is not used, to thereby stop supply of ozone gas. As a result, waste of ozone gas can be prevented. However, generally, as the total capacity of the hollow fiber membranes in an ozone solution producing equipment is relatively large compared to the amount of ozone gas produced, a relatively long time is required before the ozone gas concentration in the hollow fiber membranes becomes stabilized in a normal condition after supply of ozone gas is resumed. This results in a long time before ozone concentration of the ozone solution reaches a predetermined value, or a long start-up time, and thus an equipment of a reduced operation rate.

On the other hand, where ozone solution may be needed quickly for cleaning, a constant supply of ozone gas to the gas dissolving module must be maintained. Not only may this result in a waste of ozone gas, provision of the valve becomes meaningless.

In addition, components of the above-mentioned equipment, including pipes, must be highly pressure resistive as pressure increases on the ozone producing device side when the valve is closed, particularly, for a long time.

SUMMARY OF THE INVENTION

The present invention has been conceived to remedy the aforementioned shortcomings and aims to provide a device for producing gas solution, having a simple structure to reduce start-up time, and capable of reducing the amount of gas or solvent in use, and a method therefor, as well as a cleaning device employing the device and method.

In order to achieve the above object, according to the present invention, there is provided a gas solution producing device. The device comprises gas dissolving means for receiving gas and solvent as material of gas solution and bringing the gas and the solvent to contact to each other to thereby dissolve the gas into the solvent; a gas introducing path for introducing the gas from a gas supply source to the gas dissolving means; gas storing means, provided on the gas introducing path, for temporarily storing the gas, and, after having stored a predetermined amount of gas, for discharging the gas stored to the gas introducing path; switching means, provided at a connection between the gas introducing path and the gas storing means or a position on the gas introducing path closer to the gas dissolving means than the connection, for switching introduction and suspension of the gas flowing into the gas dissolving means by opening or closing the gas introducing path; and stored gas backflow prevention means, provided at the connection between the gas introducing path and the gas storing means or a position on the gas introducing path closer to the gas supply source, for preventing the gas discharged from the gas storing means from backflowing to the gas supply source side.

Further, according to the present invention, there is provided a method for producing gas solution using the above described gas solution producing device. The method comprises the steps of temporarily storing a predetermined amount of gas in the gas storing means while introduction of the gas from the gas supply source to the gas dissolving means is suspended by the switching means closing the gas introducing path;discharging, thereafter, the gas stored in the gas storing means to the gas dissolving means by the switching means opening the gas introducing path; and dissolving the gas into the solvent in the gas dissolving means by bringing the gas and the solvent into contact with each other.

A gas solution producing device of the present invention as described above comprises gas storing means, provided on the way of a gas introducing path connecting the gas supply source and the gas dissolving means, switching means, provided on a position on the gas introducing path closer to the gas dissolving means than a connection between the gas introducing path and the gas storing means, and stored gas black-flow preventing means, provide on a position on the gas introducing path closer to the gas supply source than the connection between the gas introducing path and the gas storing means.

With this arrangement, gas from the gas supply source is introduced into the gas storing means for temporal storage therein while gas introduction to the gas dissolving means is suspended by the switching means closing the gas introducing path. Thereafter, the gas introducing path is opened, whereby the gas temporarily stored in the gas storing means is discharged toward the gas dissolving means. During discharge, because stored gas backflow prevention means is provided to the gas solution producing device, the discharged gas does not flow back to the gas supply source, and is reliably introduced to the gas dissolving means side. When the gas and the solvent contact each other in the gas dissolving means, gas solution, containing gas dissolved in the solvent, is produced. It should be noted that the switching means and the stored gas black-flow prevention means are not necessarily separate entities, and may be a single component having both functions of these means.

A conventional gas solution producing device, in which a gas producing device is directly connected to a gas dissolving module, is very inefficient because produced gas is wasted when gas solution is not used. In contrast, in a gas solution producing device of the present invention, gas may be supplied to and stored in a gas storing means while gas introduction to the gas dissolving means is suspended, and, when a predetermined amount of gas has been stored, the stored gas can be quickly introduced to the gas dissolving means. With this arrangement, gas concentration in the dissolution membrane in the gas dissolving means can be increased rapidly, and the time necessary for ozone concentration to reach a predetermined value can be reduced. As a result, there can be provided a highly efficient gas solution producing device with a shot start-up time. in addition, gas is not wasted, and a pressure increase in a pipe constituting a gas introducing path can be suppressed.

In the above described gas solution producing device, a plurality of gas storing means, instead of only one, are provided on the way of the gas introducing path. The device may comprise switching control means for controlling such that, when gas stored in at least one of the plurality of gas storing means is discharged to the gas introducing path, gas to be supplied by the gas supply source to other gas storing means is temporarily stored, and the stored gas is not discharged to the gas introducing path.

In this case, a preferred gas solution producing method is a method comprising the steps of temporarily storing a predetermined amount of gas in at least one of the plurality of gas storing means while introduction of the gas from the gas supply source to the gas dissolving means is suspended by the switching means closing the gas introducing path; opening the gas introducing path by the switching means; repeating, under control of the switching control means and while desirably selecting gas storing means, the operation of discharging the gas stored in at least one of the plurality of gas storing means to the gas dissolving means, while storing a predetermined amount of gas in at least one of other gas storing means; and dissolving the gas into the solvent in the gas dissolving means by bringing the gas and the solvent into contact with each other.

In a gas solution producing device of the present invention, gas concentration of the produced gas solution can be controlled by controlling an amount of gas to be introduced to the gas dissolving means in a certain time period, i.e., a gas introducing speed. That is, when the gas introducing speed is high, gas concentration of the gas solution will be high. Then, when a plurality of gas storing means are provided so that gas is discharged alternately from the plurality of gas storing means to the gas dissolving means at different gas introducing speeds, gas solutions of different gas concentrations can be produced. This structure is effective when ozone solution with different concentrations must be prepared, one for use intact in cleaning and the other for mixture with hydrofluoric acid so that the resultant solution is used in cleaning.

The gas dissolving means may be a type in which a gas and solvent are brought into contact with each other via a dissolution membrane whereby the gas is dissolved into solvent. For example, as described in the section of related art, use of a gas dissolving module consisting of bundles of hollow fiber membranes in a vessel, can ensure a sufficiently large contact area between the gas and the solvent, and efficient dissolution can be attained. Also, preferably, the capacity of the gas storing means for storing gas is larger than the sum of the amount of gas allowed to remain in the gas dissolving means and the amount of gas allowed to remain in a part of the gas introducing path, the part between the gas dissolving means and the connection between the gas introducing path and the gas storing means. With this arrangement, the gas in the gas dissolving means can be exchanged at a high speed.

The gas storing means may include a gas storing section for storing the gas by enlarging a capacity thereof and for discharging the gas by reducing the capacity, and a driving mechanism for causing the gas storing section to change the capacity as desired. For example, a gas storing section may be a cylinder and a piston, or a vessel of an extendable bellows type. A driving mechanism may be provided in association with the gas storing section for driving the piston or the bellows-type vessel. A gas storing section may be made of stainless steel (preferably covered by passivated film at parts thereof directly contacting gas), fluororesin in, glass, and so on.

Also, preferably, the gas storing means has speed changing means for changing a speed at which to discharge gas stored to the gas introducing path.

A preferable gas solution producing method according to the present invention is a method in which discharge of the gas stored in the gas storing means is carried out following two steps, including a first discharge of the gas stored to the gas dissolving means at a predetermined speed, and a second discharge of the gas stored to the gas dissolving means at a speed slower than the speed in the first discharge.

As described above, when two-step discharge, including first and second discharges, is carried out, gas concentration is rapidly increased to a predetermined value by supplying the gas stored, into the gas dissolving means at a relatively high speed in first discharge operation, and the gas concentration can thereafter be maintained constant at a predetermined value by supplying the gas stored into the gas dissolving means at a speed slower than that in the first discharge operation.

A cleaning device of the resent invention is characterized by possession of a gas solution producing device of the present invention.

A cleaning device of the present invention enables to construct a gas solution producing device with a short start-up time and an efficient rate of gas usage, and makes it possible to have an available cleaning device with a high operation rate. Such cleaning device is desirable for use in manufacturing of various electronic devices, such as semiconductor devices, LCD panels, and the like.

BRIEF DESCRIPTION OF THE DRAWINGS

The above and other objects, features, and advantages of the present invention will become further apparent from the following description of the preferred embodiment taken in conjunction with the accompanying drawings wherein.

DESCRIPTION OF THE PREFERRED EMBODIMENTS

Embodiment 1

In the following, a first preferred embodiment of the present invention will be described with reference to FIGS. 1 to 5.

Figure 1:
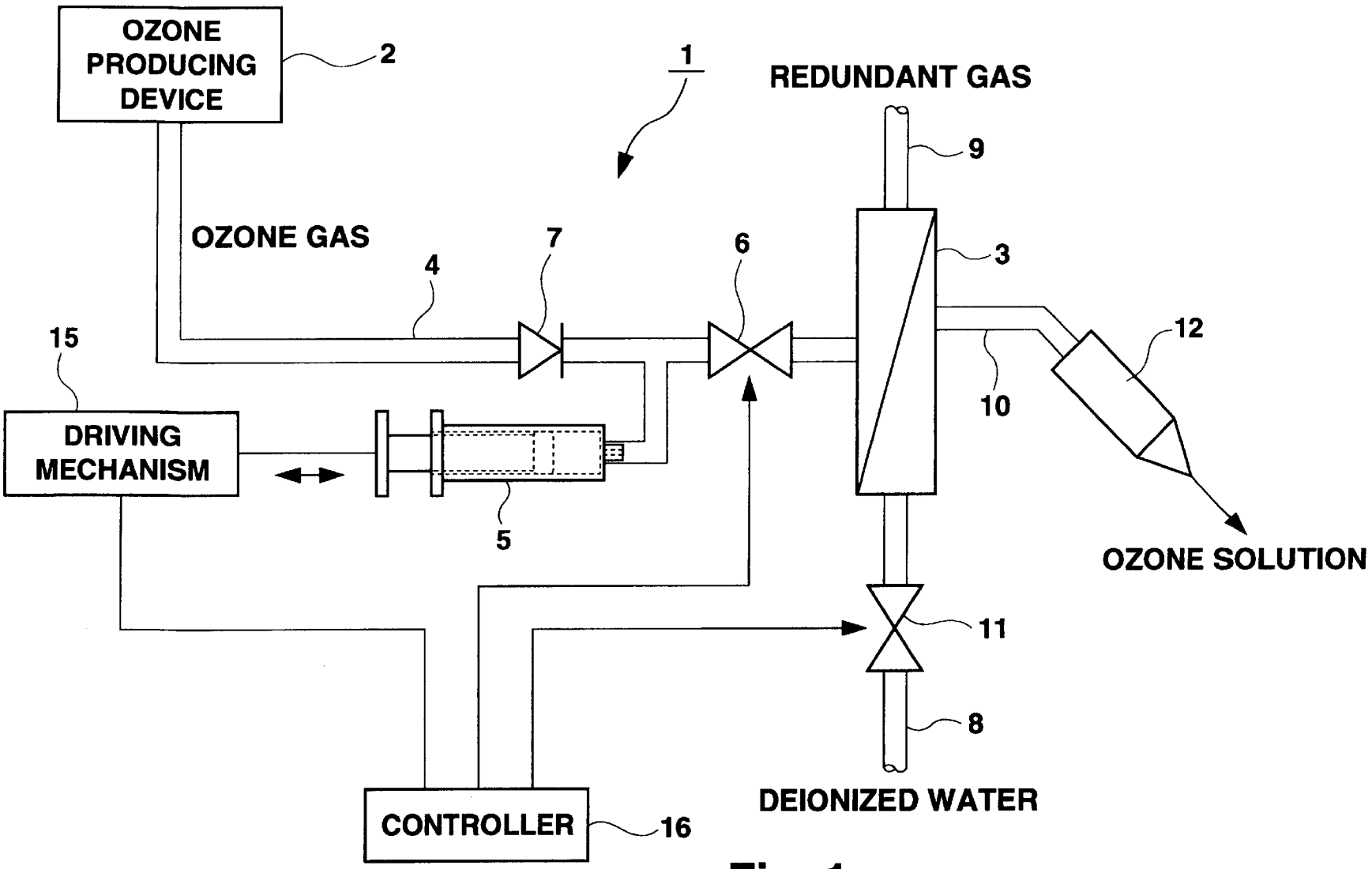
FIG. 1 is a diagram showing a schematic structure of an ozone water solution producing device according to a first preferred embodiment of the present invention.
Figure 2:
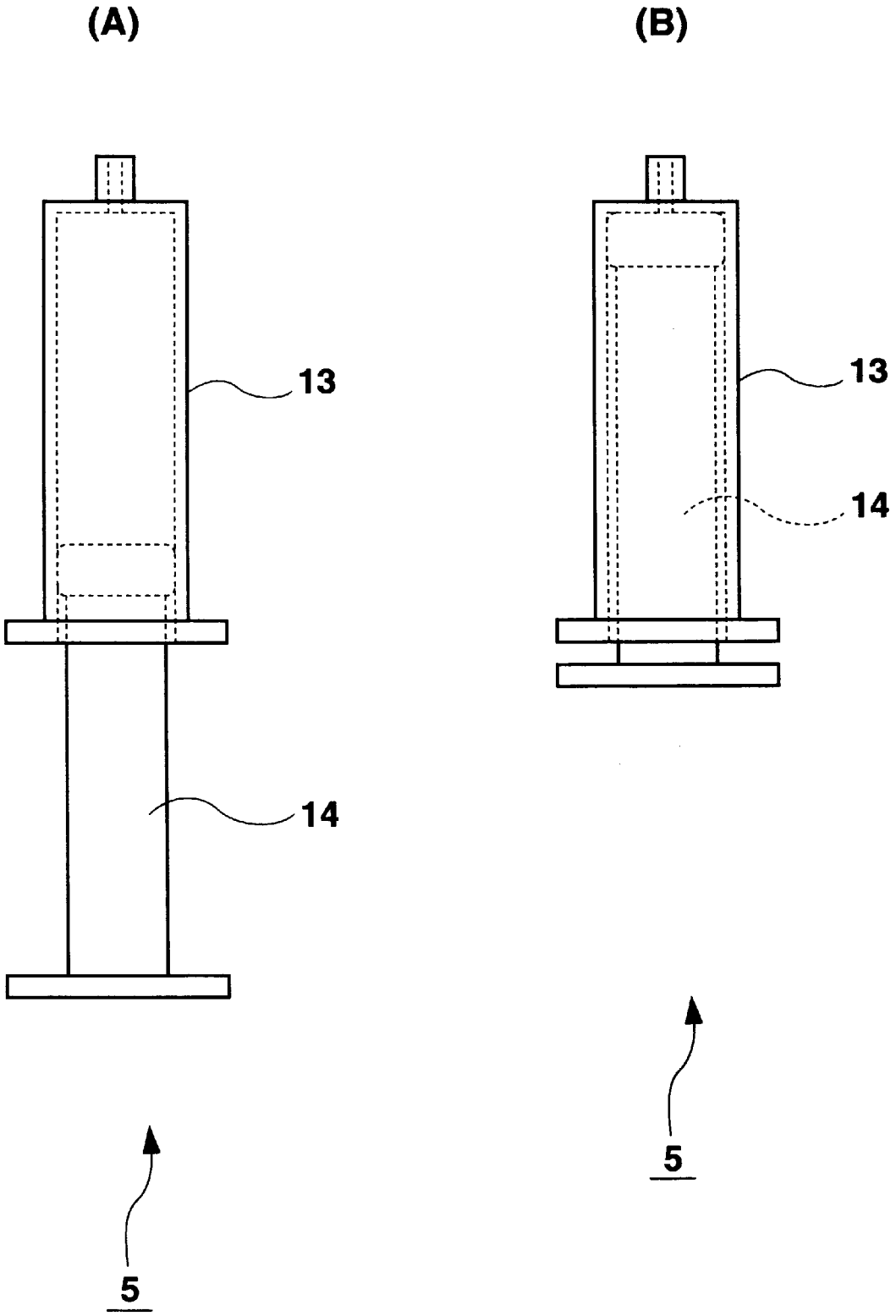
FIG. 2 is a diagram showing a buffer of the device in FIG. 1, (A) showing a state with gas stored; (B) showing a state with gas being discharged.

FIG. 1 is a diagram showing a schematic structure of an ozone solution producing device (a gas dissolved solution producing device) according to a first preferred embodiment of the present invention. This is an example of a device for producing ozone solution for use in cleaning of substrates of semiconductor devices, LCD panels, and so on, in a production line thereof.

An ozone solution producing device 1 in this embodiment comprises an ozone producing device 2 (a gas supply source), a gas dissolving module 3 (a gas dissolving means), and a gas introducing pipe 4 (a gas introducing path) for introducing ozone gas from the ozone producing device 2 to the gas dissolving module 3, as shown in FIG. 1. In the path of the gas introducing pipe 4, a buffer 5 (a gas storage means) having a sufficient capacity for storing a predetermined amount of ozone gas, e.g., on the order of a few hundreds cc, is provided. The capacity of the buffer 5 is larger than the sum of the capacity of a part of the gas introducing pipe 4 between the gas dissolving module 3 and the connection between the gas introducing pipe 4 and the buffer 5, and the capacity of the inside of the gas dissolving module 3. In the gas introducing pipe 4, at a position closer to the gas dissolving module 3 than the connection between the gas introducing pipe 4 and the buffer 5, a first valve 6 (a switching means) is provided for controlling the flow of ozone gas inside the gas introducing pipe 4. Also, in the gas introducing pipe 4, at a position closer to the ozone producing device 2 than the connection between the gas introducing pipe 4 and the buffer 5, a check valve 7 (a stored gas backflow prevention means) is provided for preventing the ozone gas discharged from the buffer 5 from flowing back into the ozone producing device 2.

In addition, the gas dissolving module 3 is further connected to a deionized water introducing pipe 8 for introducing deionized water thereto, a redundant gas discharge pipe 9 for discharging redundant ozone gas, or gas remaining as being unable to be dissolved in the deionized water, and an ozone solution draining pipe 10 for draining produced ozone solution. In the path of the deionized water introducing pipe 8, a second valve 11 is provided for passing/blocking the flow of deionized water in the pipe. The end of the ozone solution draining pipe 10 is connected to a place where the produced ozone solution is used, such as a nozzle 12 of a cleaning device in this embodiment. It should be noted that the gas dissolving module 3 is identical to a conventional one, which accommodates a number of hollow fiber membranes (dissolution membranes).

The buffer 5 is a syringe, constituting of a cylinder 13 and a piston 14, as shown in FIG. 2(A). With the piston 14 pulled out of the cylinder 13, ozone gas of an amount corresponding to the inner capacity of the cylinder 13 is stored inside the cylinder 13. With the piston 14 being pressed into the cylinder 13, as shown in FIG. 2(B), the ozone gas, stored inside, is discharged from the cylinder 13. The piston 14 is driven by a driving mechanism 15, shown in FIG. 1, such as an air cylinder. The driving mechanism 15, the first valve 6, and the second valve 11 of the ozone solution producing device 1 operate interlockingly under control by the controlling device 16. The driving mechanism 15 is constructed such that it can drive the piston 14 at either a constant speed or at a speed varying depending on a command from the control device 16 (a speed changing means).

Next, operation (sequence) of the above structured ozone solution producing device 1 will be described referring to FIG. 3.

Figure 3:
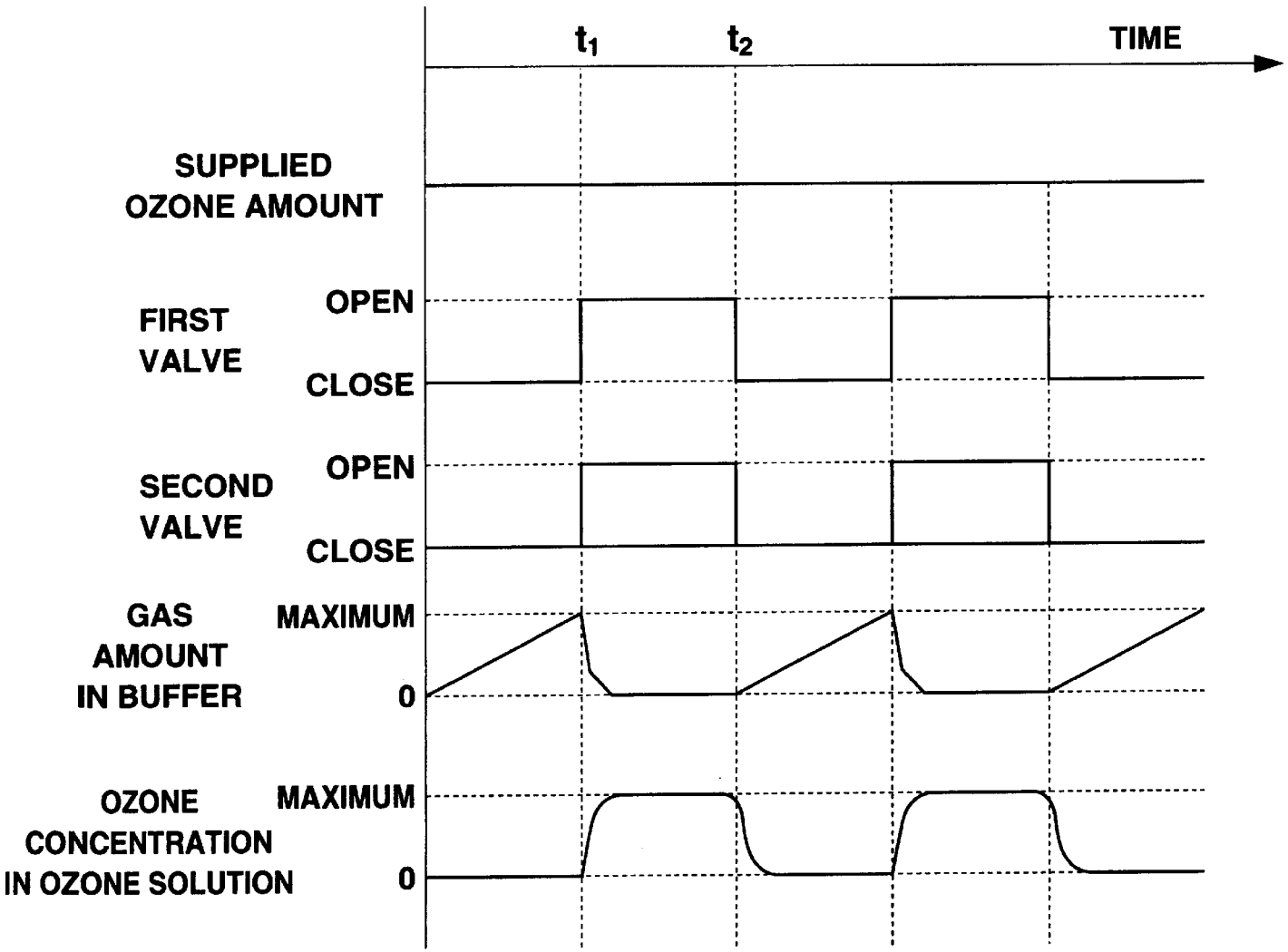
FIG. 3 is a diagram showing an operation sequence of the device shown in FIG. 1.
Figure 4:
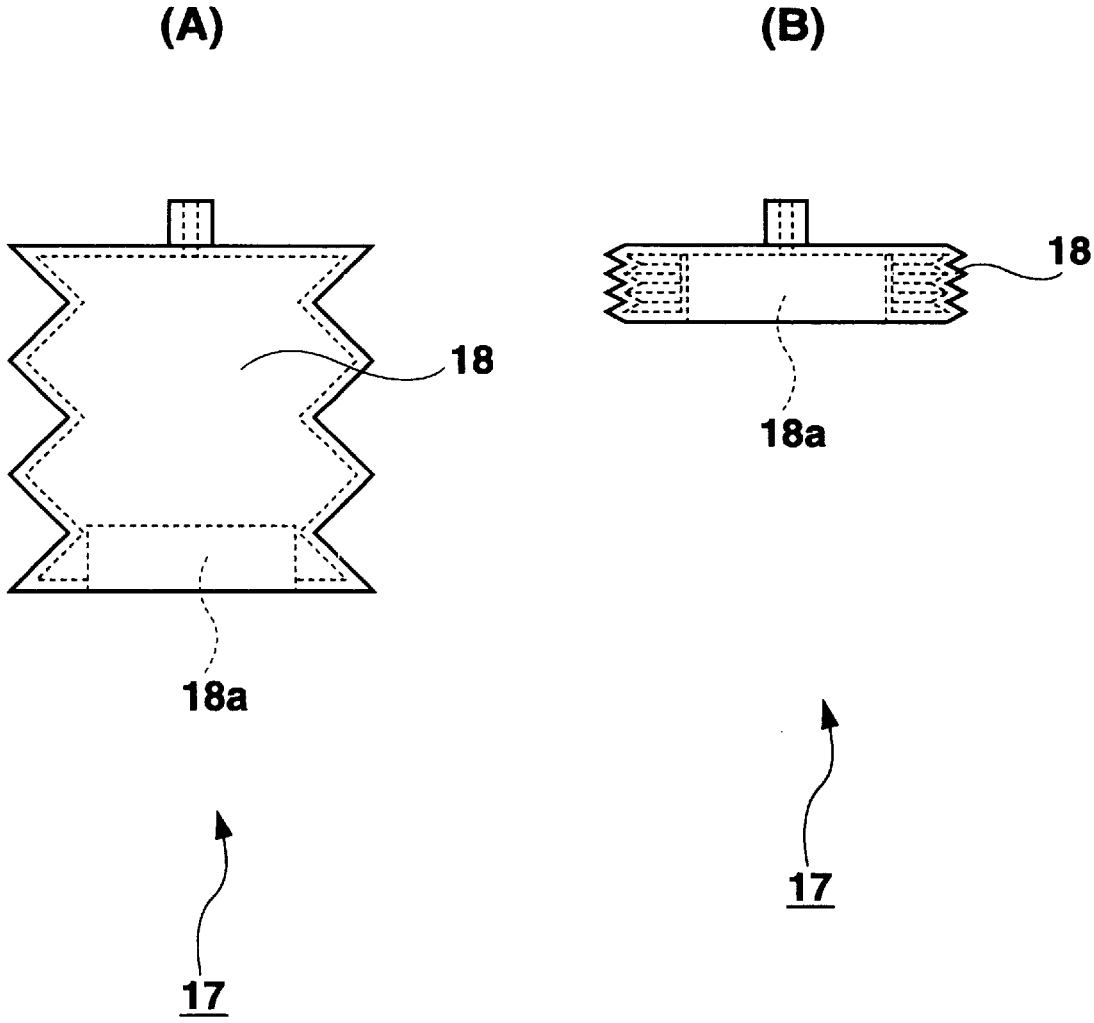
FIGS. 4(A), (B) are diagrams showing another example of a buffer.
Figure 5:
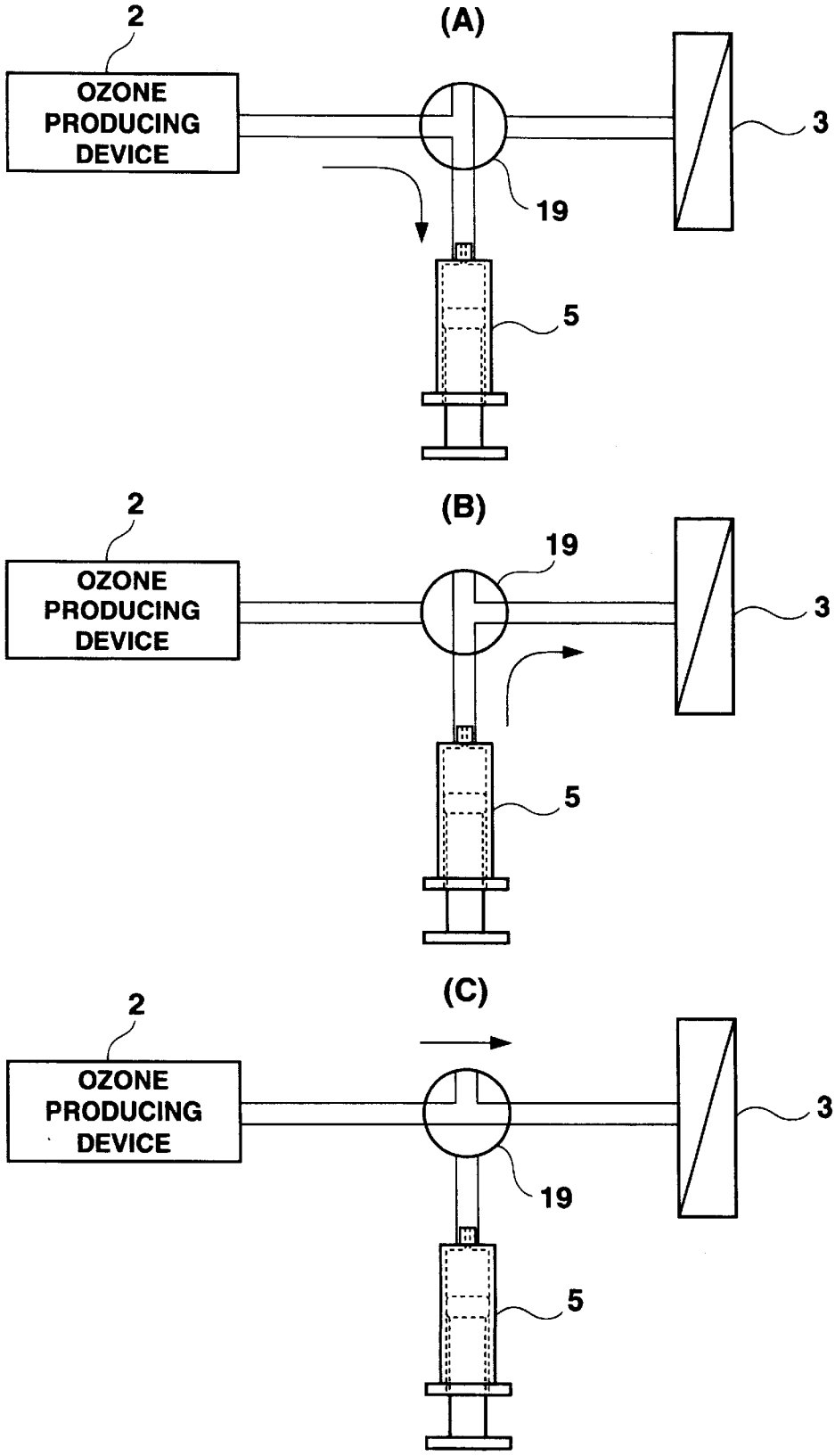
FIGS. 5(A), (B), (C) are diagrams showing a structure employing a three-way valve having a gas switching function and a backflow prevention function.

In the device of this embodiment, a constant flow (e.g., 0.5 liter/hr) of ozone gas is produced in the ozone gas producing device 2, as shown in FIG. 3. Note that, in actuality, the ozone producing device 2 produces mixture gas of $O_2$ and $O_3$, about 10% thereof being $O_3$ gas. Thus, the total amount of gas produced by the ozone producing device 2 is about 5 liters/hr. During a period from time 0 to time t1, where the first valve 6 remains closed, ozone gas is stored in the buffer 5 (see FIG. 3, the rightward rising line for "gas amount in buffer"). The second valve 11 also then remains closed, so that no deionized water is introduced to the gas dissolving module 3.

At time t1, the first valve 6 is opened, and the piston 14 of the buffer 5 is pressed into the cylinder 13 by the driving mechanism 15, whereby ozone gas of about 100 to 200 cc, stored in the buffer 5, is introduced to the gas dissolving module 3. Simultaneously, the second valve 11 is opened, whereby deionized water is introduced into the gas dissolving module 3 and thus brought into contact to the ozone gas via the hollow fiber membranes in the inside of the module, so that production of ozone solution is started.

For discharging the ozone gas stored in the buffer 5 to the gas dissolving module 3, a two-step discharge operation is carried out. In FIG. 3, the line for "gas amount in buffer" in a discharging area (a rightward declining part) consists of a sharply declining line and a moderately declining line. The sharply declining line represents first discharge operation for supplying ozone gas into the gas dissolving module 3 at a relatively high speed, while the moderately declining line represents second discharge operation for supplying ozone gas into the gas dissolving module 3 at a relatively slow speed. As time passes time t1, the ozone concentration in the ozone solution begins to rise. That is, as ozone gas is rapidly supplied to the gas dissolving module 3 through the first discharge operation, ozone concentration in the ozone solution rapidly increases from 0, and thereafter continuously increases through the second discharge operation to predetermined concentration. During the period from time t1 to t2, the first valve 6 and the second valve 11 both remain open.

At time t2, the first valve 6 is closed, and the piston 14 is pulled out of the buffer 5 by the driving mechanism 15, whereby operation for storing ozone gas in the buffer 5 is resumed. Simultaneously, the deionized valve 11 is also closed, whereby introduction of deionized water to the gas dissolving module 3 is suspended, so that production of ozone solution is discontinued. The above operation will thereafter be repeated.

According to the ozone solution producing device 1 in this embodiment, it is possible to retain ozone gas in the buffer 5 while introduction of the ozone gas to the gas dissolving module 3 is suspended, and, after a predetermined amount of ozone gas has been stored, the stored ozone gas can be rapidly introduced to the gas dissolving module 3. With this arrangement, ozone concentration in the hollow fiber membranes in the gas dissolving module 3 can be rapidly increased so that the time required for the ozone concentration in the ozone solution to reach a predetermined value can be reduced. In particular, as discharge operation of the gas from the buffer 5 to the gas dissolving module 3 is carried out at two-step sequence in this embodiment, in which the ozone gas is introduced into the gas dissolving module 3 initially at a high speed, start-up of ozone concentration in the ozone solution can be accelerated. As a result, as is obvious from the above description on the operation, a highly efficient ozone solution producing device can be realized through reduction of a short start-up time of ozone concentration when ozone solution is used, and elimination of wasted ozone gas when ozone solution is not used as ozone gas is not introduced into the gas dissolving module 3. Similarly, according to an ozone solution producing device 1 of the present invention, the amount of deionized water to be used can be reduced. Further, a pressure increase in the gas introducing pipe 4 can be suppressed as ozone gas flows into the buffer 5 even when the first valve 6 is closed.

It should be noted that the buffer 5, which is a syringe in the above, may be a buffer 17 comprising a vessel 18 of a bellows type, as shown in FIG. 4(A). As for the buffer 17, a convex 18*a* may be formed on the inside bottom of the vessel 18 so that as much gas as possible can be discharged, leaving little, if any, gas inside, when the vessel 18 is contracted to the extreme, as shown in FIG. 4(B).

In addition, instead of using two separate valves of the first valve 6 for switching between supplies of ozone gas from the ozone producing device 2 to the gas dissolving module 3 side and to the buffer 5 side, and the check valve 7 for preventing backflow of the ozone gas to the ozone producing device 2 side when the stored ozone gas is discharged, as shown in FIG. 1, a three-way valve having two functions, namely, a switching function and a backflow preventing function, may be used, as shown in FIGS. 5(A) to 5(C). FIG. 5(A) shows a state in which a gas path connects the ozone producing device 2 and the buffer 5 with the gas dissolving module 3 being cut off, so that the gas is stored in the buffer 5. FIG. 5(B) shows a state in which a gas path connects between the buffer 5 and the gas dissolving module 3 with the ozone producing device 2 being cut off, so that the gas stored in the buffer 5 is discharged to the gas dissolving module 3. FIG. 5(C) shows a state in which a gas path connects the ozone producing device 2 and the gas dissolving module 3 with the buffer 5 being cut off, so that the gas from the ozone producing device 2 is directly introduced to the gas dissolving module 3 for production of ozone solution. That is, the example in FIG. 1, which does not have a sequence for introducing gas from the ozone producing device 2 directly to the gas dissolving module 3 for ozone solution production, may be reconstructed into the structure shown in FIGS. 5(A) to 5(C) so that ozone solution can be produced through direct introduction of gas from the ozone producing device 2 to the gas dissolving module 3.

Embodiment 2

In the following, a second preferred embodiment of the present invention will be described with reference to FIGS. 6 to 8.

Figure 6:
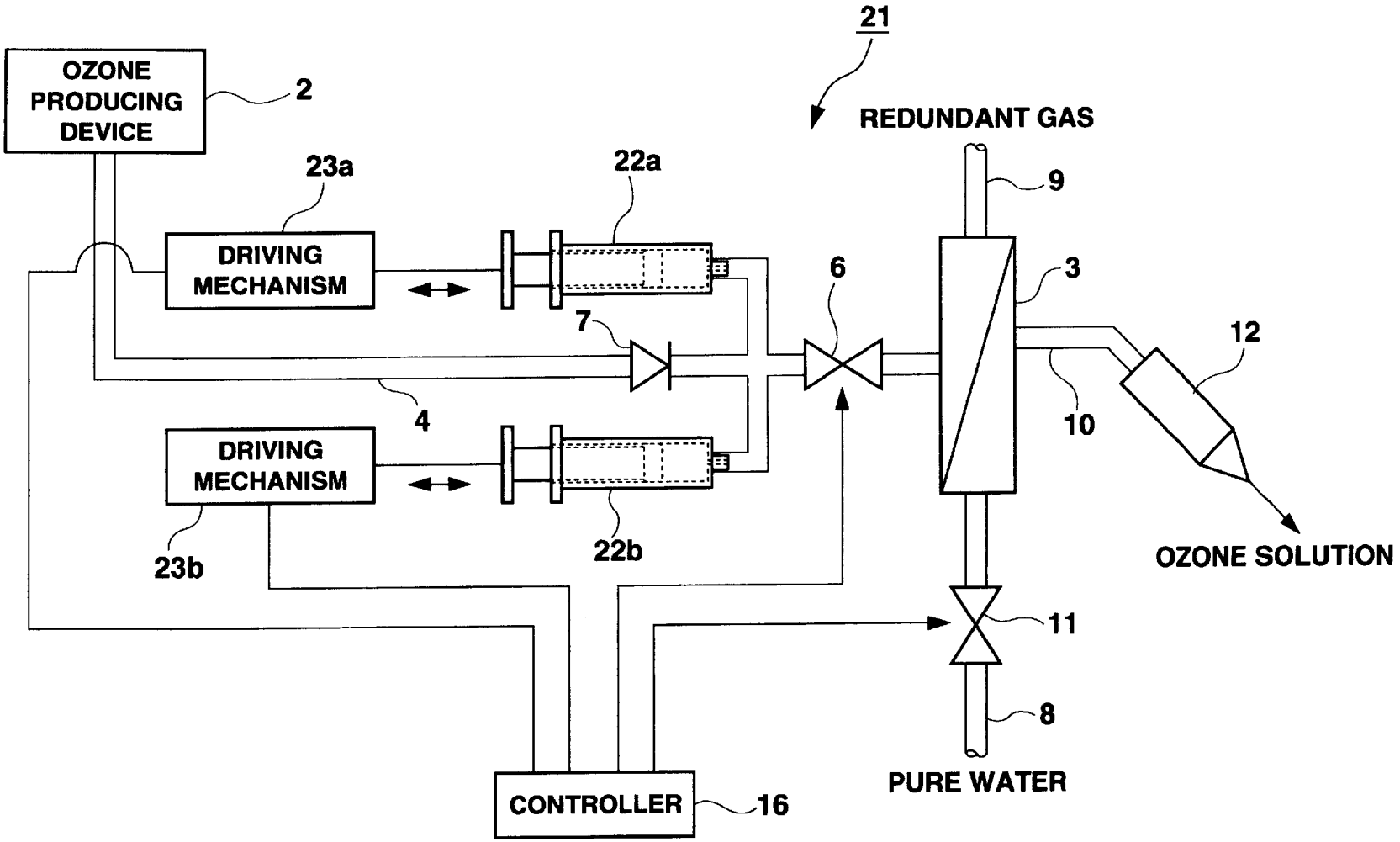
FIG. 6 is a diagram showing a schematic structure of structure of an ozone water solution producing device according to a second preferred embodiment of the present invention.

FIG. 6 is a diagram showing a schematic structure of an ozone solution producing device in this embodiment. This structure is almost identical to that of the device in the first embodiment, with the only difference being that a plurality of buffers (specifically, two) are provided. Components of the device in FIG. 6 corresponding to those in FIG. 1 are given identical reference numerals and their detailed explanation is not repeated here.

In the ozone solution producing device 21 in this embodiment, two buffers, namely a first buffer 22*a* and a second buffer 22*b*, are provided in the gas introducing pipe 4, which connects the ozone producing device 2 and the gas dissolving module 3. The first and second buffers 22*a*, 22*b* are connected to driving mechanisms 23*a*, 23*b*, respectively, and the respective pistons of the buffers 22*a*, 22*b* are independently driven by the controlling device 16.

Next, operation (sequence) of the ozone solution producing device 21 in this embodiment will be described with reference to FIG. 7.

Figure 7:
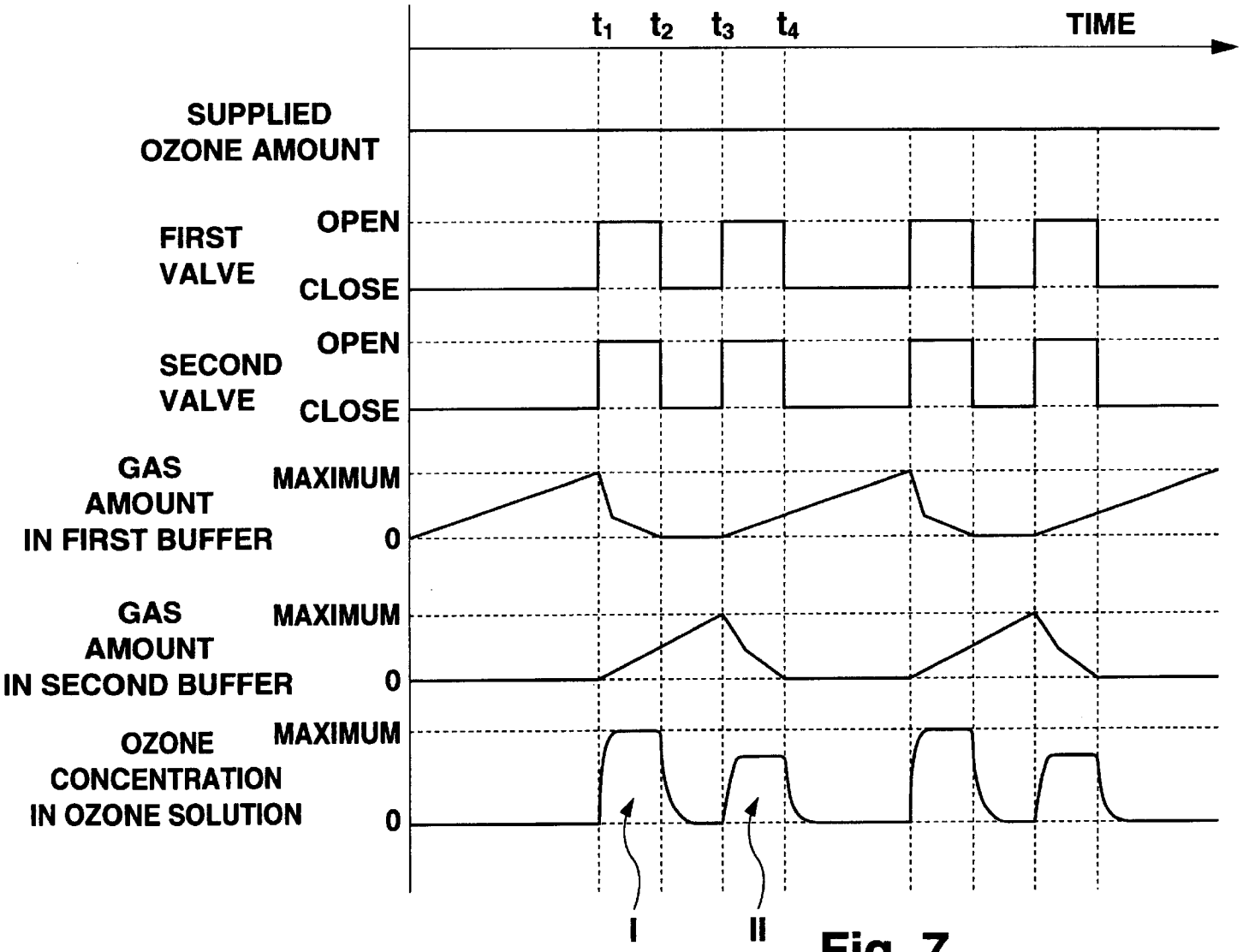
FIG. 7 is a diagram showing an operation sequence of the device shown in FIG. 6.
Figure 8:
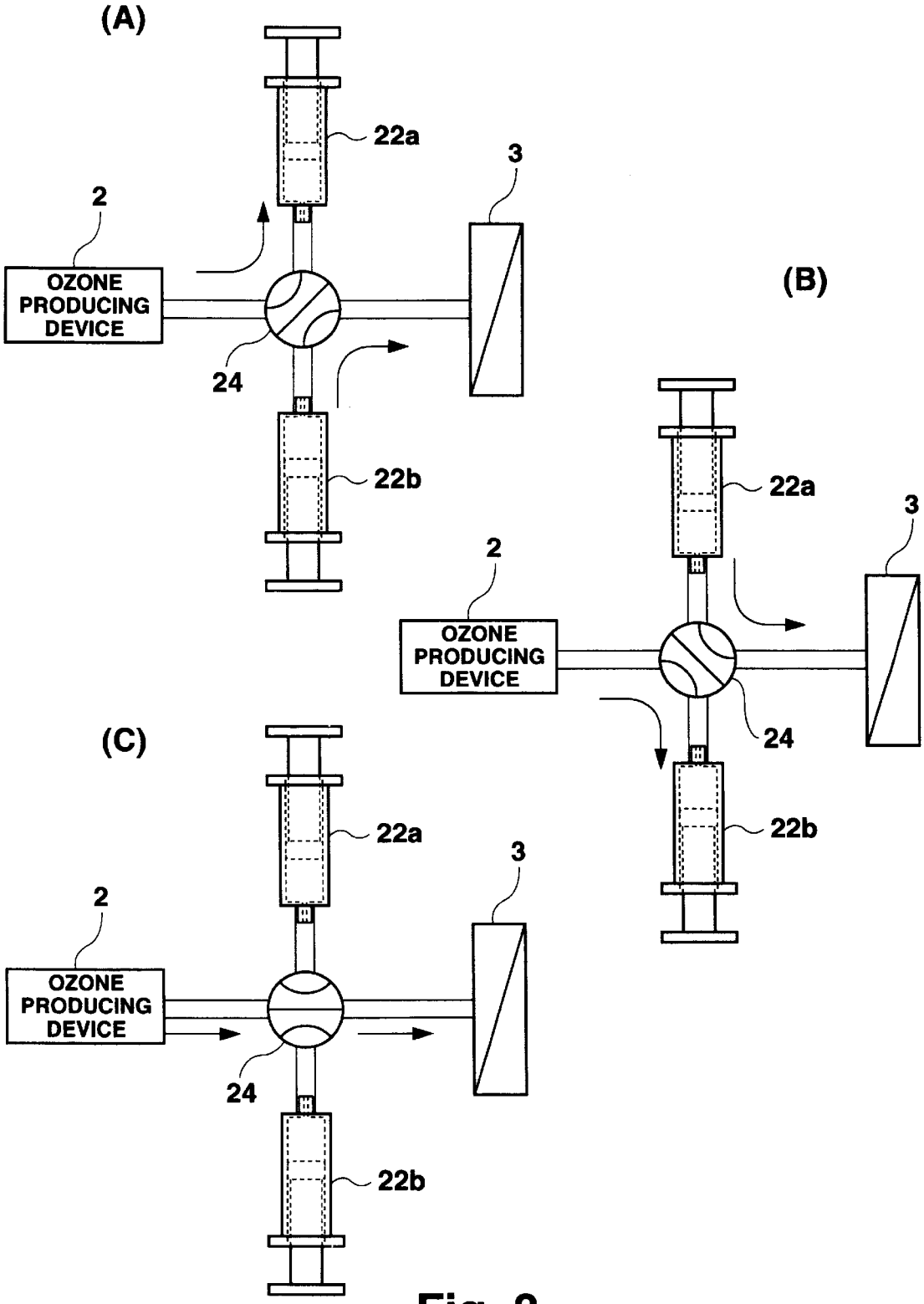
FIGS. 8(A), (B), (C) are diagrams showing a structure employing three-way valve having a gas switching function and a backflow prevention function.

As shown in FIG. 7, a constant flow (e.g., 0.5 liter/hr) of ozone gas is produced by the ozone producing device 2. During a period from time 0 to time t1, the first valve 6 remains closed and the piston of the first buffer 22*a* remains pulled out, so that ozone gas can be stored in the first buffer 22*a*, while the piston of second buffer 22*b* remains pressed therein, so that no ozone gas is stored in the second buffer 22*b*. As a result, ozone gas is being stored in the first buffer 22*a* during the period from 0 to t1. During this period, the second valve 11 also remains closed, so that no deionized water is introduced to the gas dissolving module 3.

At time t1, the first valve 6 is opened, and the piston of the first buffer 22*a* is pressed into the first buffer 22*a* by the driving mechanism 23*a*, whereby a predetermined amount of ozone gas, stored in the first buffer 22*a,* is introduced to the gas dissolving module 3. Simultaneously, the second valve 11 is opened, whereby deionized water is introduced into the gas dissolving module 3 and brought into contact with the ozone gas via the hollow fiber membranes in the inside of the module, so that first ozone solution production is started (see FIG. 7, indicated by reference I).

For discharging the ozone gas stored in the buffer 22*a* to the gas dissolving module 3, two-step discharge operation is carried out at high and low flow speeds, which is similar to the first embodiment, so that ozone concentration of the ozone solution can increase rapidly to a steady state. On the other hand, at time t1, the piston of the first buffer 22*a* is pressed in the first buffer 22*a,* and, simultaneously, the piston of the second buffer 22*b* is pulled out, so that storage of ozone gas from the ozone producing device 2 in the second buffer 22*b* is started. It should be noted that the speed at which the piston of the second buffer 22*b* is pulled out is less than half of the speed at which the piston of the first buffer 22*a* is pressed into the first buffer 22*a,* as is obvious from the change in the amount of gas stored in the first and second buffers 22*a,* 22*b* during a period from t1, t2, to t3 in FIG. 7. Thus, most of the ozone gas pushed out from the first buffer 22*a* is introduced to the gas dissolving module 3, with only a negligible amount of gas moving to the second buffer 22*b* side.

At time t2, by which point discharge of ozone gas from the first buffer 22*a* to the gas dissolving module 3 has been completed, the first valve 6 and the second valve 11 are both closed, so that the first ozone solution production is halted. At this point, ozone gas is still stored in the second buffer 22*b.*

At time t3, the first valve 6 is opened, and the piston of the second buffer 22*b* is pressed into the second buffer 22*b* by the driving mechanism 23*b,* whereby a predetermined amount of ozone gas, stored in the second buffer 22*b,* is introduced into the gas dissolving module 3. At the same time, the second valve 11 comes to be in an open state, and deionized water is supplied to the gas dissolving module 3 to be brought into contact with ozone gas via the hollow fiber membranes in the module, so that second ozone solution production is started (indicated by reference numeral II in FIG. 7). Then, when, in response to a command from the controlling device 16, an amount of ozone gas to be stored in the second buffer 22*b* or the speed at which ozone gas is to be supplied to the gas dissolving module 3 or the like, is changed from the values for the first buffer 22*a,* ozone concentration of the produced ozone solution can be changed from that of the first ozone solution production. Also, at time t3, the piston of the second buffer 22*b* is pressed in the second buffer 22*b,* and the piston of the first buffer 22*a* is pulled out, so that ozone gas storing operation is resumed on the first buffer 22*a* side.

At time t4, by which point discharge of the ozone gas from the second buffer 22*b* to the gas dissolving module 3 has been completed, the first valve 6 and the second valve 11 are both in a closed state, so that the second ozone solution production is halted. At this time, ozone gas is still stored in the first buffer 22*a.* The above operation will thereafter be repeated. That is, under control by the controlling device 16 (a switch control means), gas storing operation and gas discharge operation are carried out alternately, not simultaneously, with respect to the first buffer 22*a* and the second buffer 22*b.*

As described above, the ozone solution producing device 21 of this embodiment can attain the same advantage as that which would be obtained in the first preferred embodiment, specifically, realization of a highly efficient ozone solution producing device with a short start-up time and less waste of ozone gas or deionized water. Further, a device configured according to this embodiment can produce an additional advantage, such that ozone solution with two different concentrations can be produced due to provision of two buffers 22*a,* 22*b* by changing an amount of gas allowed to be stored or a speed at which to discharge the gas, and so on, for the respective buffers 22*a,* 22*b.* Thus, this embodiment is particularly effective in a case where ozone solution with different concentrations must be prepared, one for use intact in cleaning and the other for mixture with hydrofluoric acid so that the resultant solution is used in cleaning.

Note that, although, as shown in FIG. 6, the first valve 6 for switching between supplies of ozone gas from the ozone producing device 2 to the gas dissolving module 3 side and to the buffers 22*a* and 23*b,* and the check valve 7 for preventing backflow of the ozone gas to the ozone producing device 2 side when the stored ozone gas is discharged are shown as separate components in this embodiment, as in the case of the first embodiment, these valves may be substituted by a single three-way valve 24, which has both switching function and backflow prevention function, as shown in FIG. 8(A) to 8(C). FIG. 8(A) shows a gas path connecting the ozone producing device 2 and the first buffer 22*a,* and another gas path connecting the second buffer 22*b* and the gas dissolving module 3, so that gas is stored on the first buffer 22*a* side and gas is discharged from the second buffer 22*b* side. FIG. 8(B) shows a gas path connecting the ozone producing device 2 and the second buffer 22*b,* and another gas path connecting the first buffer 22*a* and the gas dissolving module 3, so that gas is stored on the second buffer 22*b* side, and gas is discharged from the first buffer 22*a* side. FIG. 8(C) shows a gas path connecting the ozone producing device 2 and the gas dissolving module 3 with the first buffer 22*a* and the second buffer 22*b* being both blocked, so that gas from the ozone producing device 2 is directly introduced to the gas dissolving module 3 for use in ozone solution production. That is, the example in FIG. 6, which does not have a sequence for producing ozone solution through direct introduction of gas from the ozone producing device 2 to the gas dissolving module 3, may be reconstructed into a structure shown in FIGS. 8(A) to 8(C), to allow direct introduction of gas from the ozone producing device 2 to the gas dissolving module 3 for gas solution production.

Embodiment 3

In the following, a third preferred embodiment of the present invention will be described with reference to FIG. 9.

Figure 9:
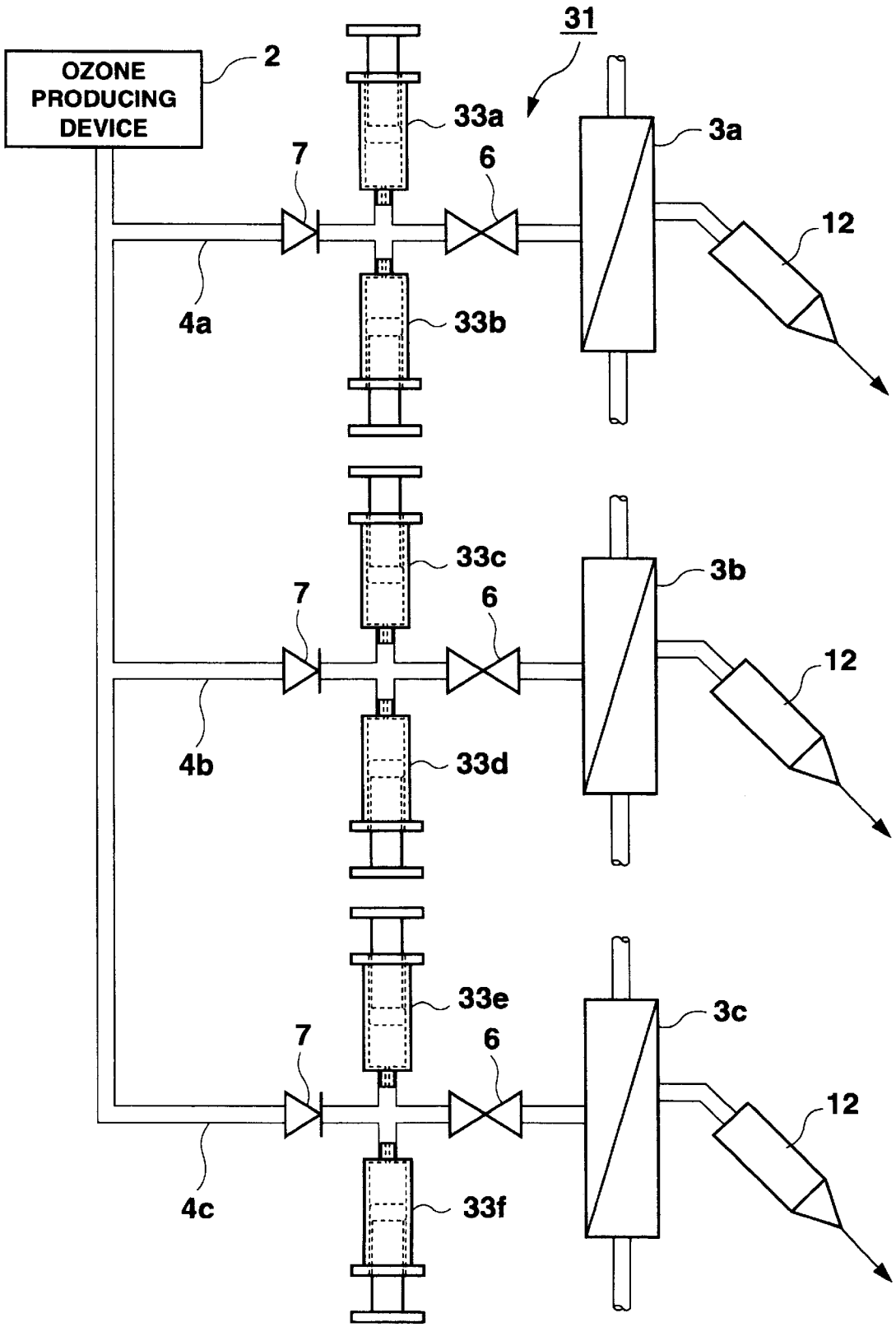
FIG. 9 is a diagram showing a schematic structure of structure of an ozone water solution producing device according to a third preferred embodiment of the present invention.

FIG. 9 is a diagram showing a schematic structure of an ozone solution producing device in this embodiment. This embodiment is preferable particularly in a case, e.g., where a plurality of ozone solution producing devices are connected to a single ozone producing device in an electronic device manufacturing line including a plurality of cleaning devices.

The ozone solution producing device 31 in this embodiment has a plurality of (three in this embodiment) gas introducing pipes 4*a,* 4*b,* 4*c* connected in parallel to a single ozone producing device 2, as shown in FIG. 9, and each gas introducing pipe also connected to two buffers 33*a*/33*b,* 33*c*/33*d,* or 33*e*/33*f* and one gas dissolving module 3*a,* 3*b,* or 3*c,* in much the same manner as the second embodiment. The structures of the first valve 6 and the backflow prevention valve 7 are identical to those in the first and second preferred embodiments.

Supposing that three gas dissolving modules 3*a,* 3*b,* 3*c* connected to a single ozone producing device 2, as described above, and without a buffer are used, problems may result if production of ozone solution is halted in one of the three modules. Specifically, in such a situation, the remaining two modules may be supplied with an increased amount of gas corresponding to the amount which would otherwise be supplied to the suspended module, with a result that the ozone concentration of the ozone solution produced by the two modules may vary. In this embodiment, by contrast, as two buffers 33*a*/33*b*, 33*c*/33*d*, or 33*e*/33*f* are provided to each of the gas introducing pipes 4*a*, 4*b*, and 4*c* so that gas can be stored in the buffers 33*a* to 33*f* when ozone solution is not used in any pipe system, an amount of gas to be supplied to other systems will not vary significantly. Thus, ozone concentration of the produced ozone solution can be stabilized.

Embodiment 4

A fourth preferred embodiment of the present invention will next be described with reference to FIG. 10.

Figure 10:
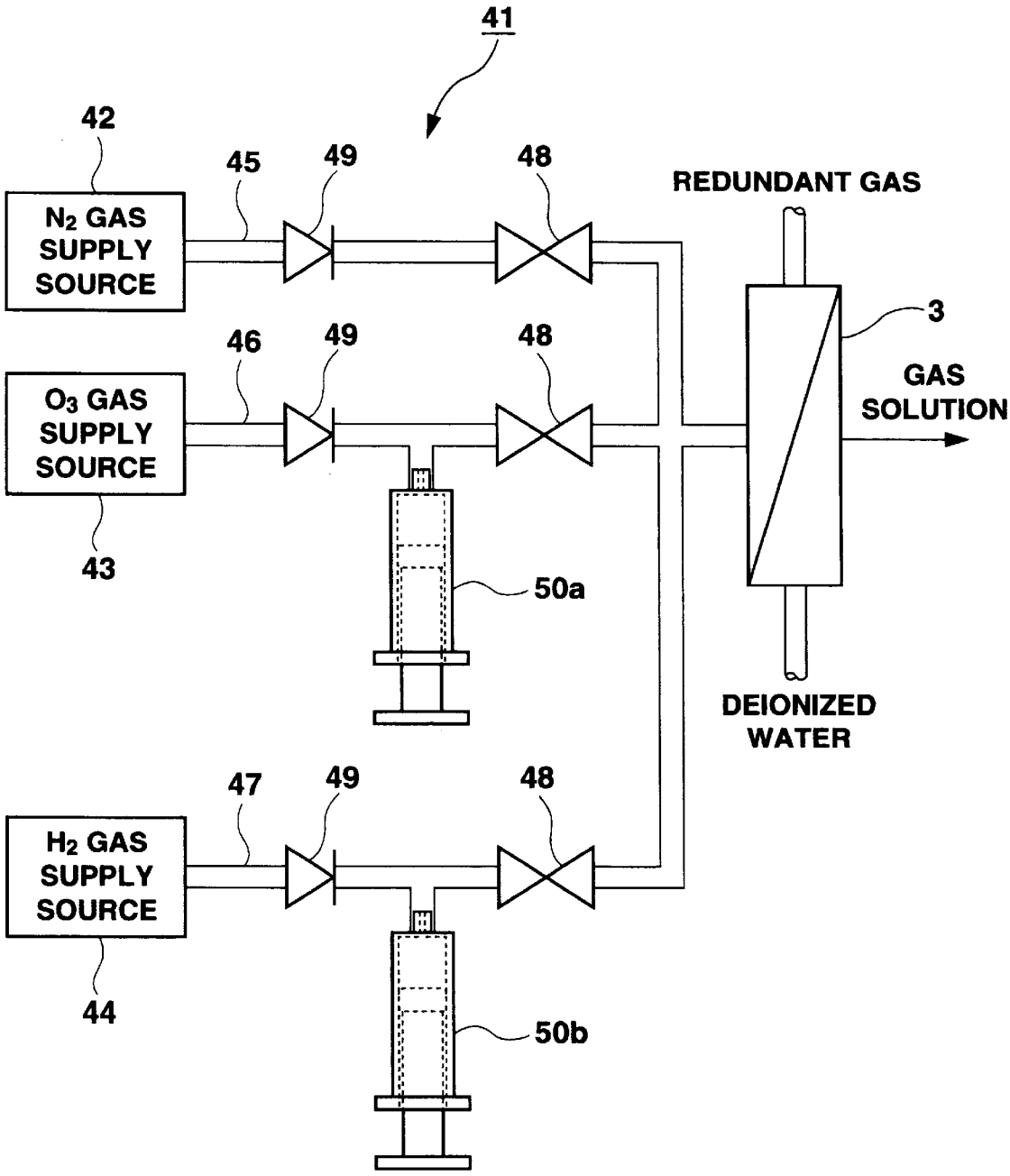
FIG. 10 is a diagram showing a schematic structure of structure of an ozone solution producing device according to a fourth preferred embodiment of the present invention.

FIG. 10 is a diagram showing a schematic structure of a gas solution producing device in this embodiment. This embodiment is preferable particularly as associated equipment of a cleaning device, e.g., which employs two or more different cleaning solutions containing such gasses as ozone, hydrogen, and the like.

A gas solution producing device 41 of this embodiment comprises three pipe systems, connected to a single gas dissolving module 3, including a nitrogen gas introducing pipe 45 connected to a nitrogen gas supply source 42, an ozone gas introducing pipe 46 connected to an zone gas supply source 43, and a hydrogen gas introducing pipe 47 connected to a hydrogen gas supply source 44. The nitrogen gas introducing pipe 45 is provided, in the middle thereof, with a valve 48 and a check valve 49, while the ozone gas introducing pipe 46 and the hydrogen gas introducing pipe 47 are additionally provided, between a valve 48 and a check valve 49, with buffers 50*a* and 50*b*, respectively.

The gas solution producing device 41 in this embodiment can produce two types of cleaning gas solution, i.e., ozone solution and hydrogen solution, and uses nitrogen gas as a substitutional gas when switching between ozone solution production and hydrogen solution production. That is, ozone gas discharge from the buffer 50*a* to the gas dissolving module 3 and hydrogen gas discharge from the buffer 50*b* to the gas dissolving module 3 are carried out alternately in the same manner as the sequence of a device having two buffers in the second embodiment, so that ozone solution and hydrogen solution can be produced alternately using a single gas dissolving module 3. When switching between ozone gas discharge and hydrogen gas discharge, the valve 48 on the nitrogen gas introducing pipe 45 remains open while valves 48 on the ozone gas introducing pipe 46 and the hydrogen gas introducing pipe 47 remain closed so that nitrogen gas is supplied to the gas dissolving module 3 for substitution of the residual gas therein.

With the gas solution producing device 41 in this embodiment, two types of cleaning gas solution can be produced using a single gas dissolving module 3, and an efficient device can thus be realized. In particular, ozone gas and hydrogen gas, which would otherwise react with each other, can be rapidly dissolved in deionized water without mixing. Also, as nitrogen gas is always supplied while switching between ozone gas discharge and hydrogen gas discharge, constant conditions can be ensured in the gas dissolving module at the time to start dissolution of ozone or hydrogen. Thus, constant dissolution condition of the effective components (gasses) can be ensured, which can improve consistency in gas concentration.

Embodiment 5

A fifth preferred embodiment of the present invention will be described with reference to FIG. 11.

This embodiment is an example of a cleaning device equipped with a gas solution producing device. FIG. 11 is a diagram showing a schematic structure of a cleaning device 51 in this embodiment, which may be, e.g., a device for sheet cleaning of large glass substrates (hereinafter simply referred to as a substrate), each being on the order of a few hundred square mm.

The drawing shows a cleaning section 52, a stage 53, cleaning nozzles 54, 55, 56, a substrate carrying robot 57, a loader cassette 58, an unloader cassette 59, a hydrogen water solution/ozone water solution producing section 60, a cleaning solution rejuvenation section 61, and a substrate W.

Figure 11:
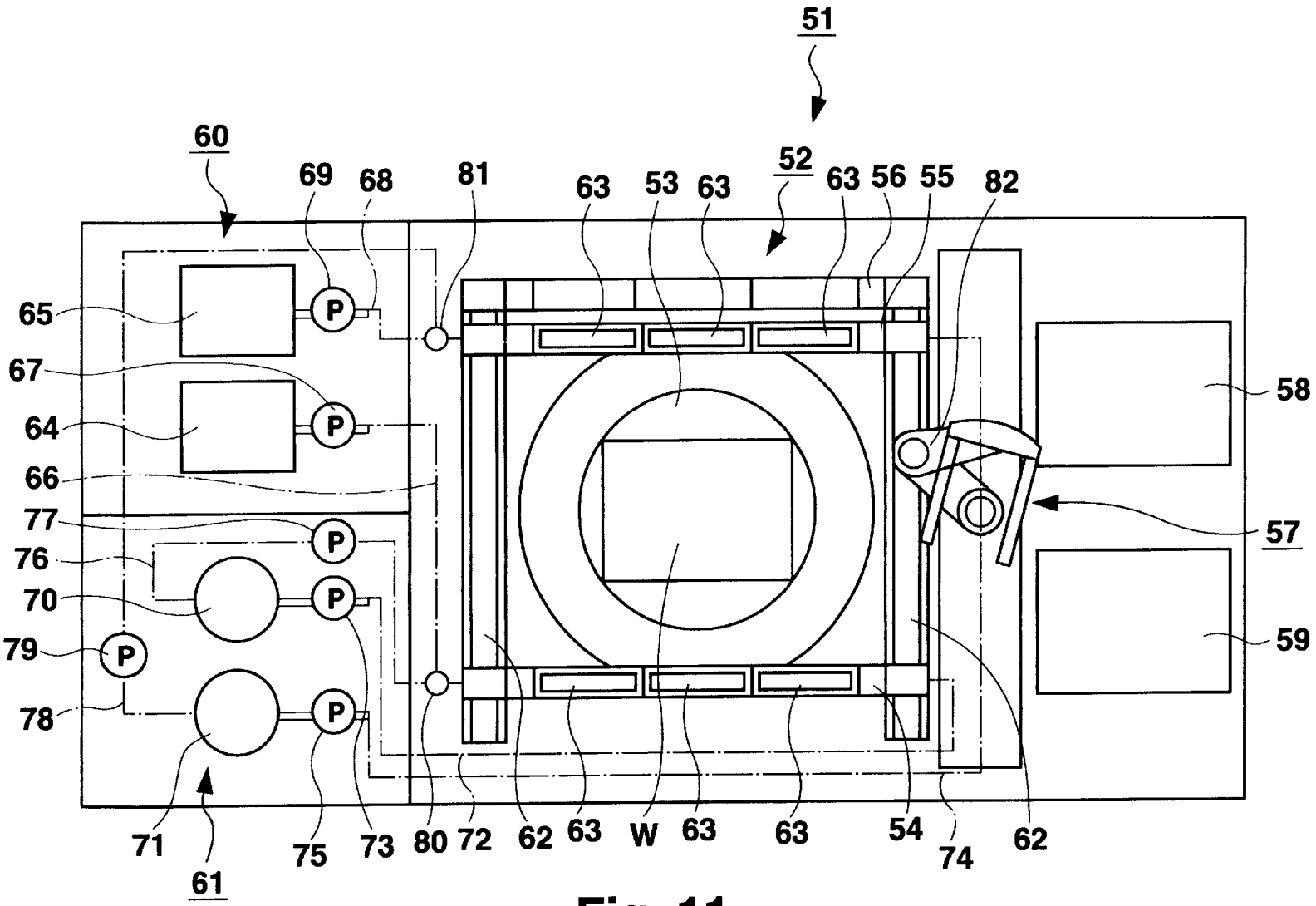
FIG. 11 is a diagram showing a schematic structure of structure of an ozone solution producing device according to a fifth preferred embodiment of the present invention.

As shown in FIG. 11, the middle of the upper surface of the device constitutes a cleaning section 52, where a stage 53 is formed for holding a substrate W. A concave in a rectangular shape corresponding to the shape of a substrate W is formed on the stage 53 so that the substrate W can be fit into the concave and supported on the stage 53 such that the surface of the substrate W and the surface of the stage 53 come into close contact with each other. Also, space is formed in the lower part of the concave, into which a substrate elevation shaft protrudes from the lower part of the stage 53. At the lower end of the substrate elevation shaft, a shaft driving source, such as a cylinder, is provided, so that the substrate elevation shaft and accordingly the substrate W also are moved vertically due to the operation of the cylinder when a substrate W is positioned on a substrate carrying robot 57 (described later). Note that a nozzle protrudes through an opening on the middle part of the stage, for cleaning the rear surface of the substrate W. With this arrangement, the rear surface of a substrate can be roughly cleaned while the front surface thereof is mainly cleaned in this device.

A pair of rack bases 62 are provided opposing each other with the stage 53 intervening, and cleaning nozzles 54, 55, 56 are formed bridging between the rack bases 62. Cleaning nozzles comprise three nozzles arranged in parallel, each for cleaning in different manners. In this embodiment, these three nozzles are a hydrogen water supersonic cleaning nozzle 54 for cleaning with hydrogen water solution while applying supersonic vibration by a supersonic element 63, an ozone supersonic cleaning nozzle 55 for cleaning with ozone water solution while applying supersonic vibration by a supersonic element 63, and a deionized water rinsing nozzle 56 for rinsing with deionized water. These three nozzles sequentially move along the rack bases 62 above the substrate W while keeping a constant distance from the substrate W, so that the entire area of the substrate W is cleaned in three different cleaning agents.

As a nozzle moving means, horizontally movable sliders are provided along the linear guides on the respective rack bases 62. Pillars are formed on the upper surfaces of the respective sliders, to which both ends of the cleaning nozzles 54, 55, 56 are fixed. Driving sources, such as a motor, are provided on the respective sliders, so that the respective sliders automatically move on the rack bases 62. When the driving sources (motors) on the respective sliders operate in response to a control signal from the controlling device (not shown) of the device, the cleaning nozzles 54, 55, 56 individually move horizontally. Also, a driving source, such as a cylinder (not shown), is provided to the pillar so that the height of the respective cleaning nozzles 54, 55, 56, i.e., the distances between the respective cleaning nozzles and the substrate W, can be adjusted by vertical movement of the pillars.

The respective cleaning nozzles 54, 55, 56 are referred to as push/pull nozzles, in which each has an introducing path and a draining path. The introducing path has an introducing opening formed on one end thereof for introducing cleaning solution. The draining path has a draining opening formed on one end thereof for draining the cleaning waste solution. The introducing path and the draining path cross over to each other at the other ends thereof, thereby constituting a crossing section. An opening is formed on the crossing section, facing the substrate W. In this case, the opening is formed extending at least longer than the width of the substrate W in the direction perpendicular to the direction in which cleaning nozzles 54, 55, 56 are arranged in parallel (in this embodiment, three crossing sections and openings are formed for each cleaning nozzle, the three openings combined extending longer than the width of the substrate W). A pressure reducing pump is employed as a pressure control device provided on the discharge path side. The force for sucking the cleaning solution on the crossing section is controlled by using the pressure reducing pump so that the pressure of the cleaning solution in contact with the atmosphere via the opening section (including surface tension of the cleaning solution and that of the surface to be cleaned of the substrate W) is balanced with the atmosphere pressure. That is, when $Pw \approx Pa$ is held for the relationship between the pressure Pw of the cleaning solution in contact with the atmosphere via the opening section (including surface tension of the cleaning solution and that of the surface to be cleaned of the substrate W) and the air pressure Pa, the cleaning solution supplied via the opening section to the substrate W and thus brought into contact therewith is directed to the draining path without leakage to the outside of the cleaning nozzle. That is, the cleaning solution supplied from the cleaning nozzle to the substrate W is removed from the substrate W, without contacting parts other than the part via which the cleaning solution was supplied, or the opening section. Further, a supersonic element 63 is provided above the crossing section, opposing the substrate W, so that supersonics are applied to the cleaning solution while the substrate W is being cleaned.

On the flank side of the cleaning section 52, there are formed a hydrogen water solution/ozone water solution producing section 60 and a cleaning solution rejuvenation section 61. The hydrogen water solution/ozone water solution producing section 60 incorporates a hydrogen solution producing device 64 and an ozone solution producing device 65, as described in the preceding embodiment. These cleaning solutions can be produced by dissolving hydrogen gas or ozone gas into deionized water. Hydrogen solution, produced by the hydrogen solution producing device 64, is supplied to the hydrogen supersonic cleaning nozzle 54 via a liquid feeding pump 67, provided on the hydrogen solution supply pipe 66. Similarly, ozone solution, produced by the ozone solution producing device 65, is supplied to the ozone supersonic cleaning nozzle 55 via the liquid feeding pump 69, provided on the ozone solution supply pipe 68. Note that the deionized water rinse cleaning nozzle 56 is supplied with deionized water from a deionized water supply pipe (not shown) in a manufacturing line.

The cleaning solution rejuvenation section 61 is provided with filters 70, 71 for removing particles and other foreign materials in the cleaning solution after cleaning. Specifically, the filter 70 for removing particles and other foreign materials in hydrogen solution and a filter 71 for removing those in ozone solution are provided separately. That is, used hydrogen water, drained from the drain opening of the hydrogen water supersonic cleaning nozzle 54, is fed to a filter 70 by a liquid feeding pump 73, provided on the hydrogen water collecting pipe 72. Similarly, used ozone water, drained from the drain opening of the ozone supersonic cleaning nozzle 55, is fed to a filter 71 by a liquid feeding pump 75, provided on the ozone solution collecting pipe 74.

Then, hydrogen water filtered via the filter 70 is supplied to the hydrogen supersonic cleaning nozzle 54 by a liquid feeding pump 77, provided on the rejuvenated hydrogen solution supply pipe 76. Similarly, ozone water filtered via the filter 71 is supplied to the ozone supersonic cleaning nozzle 55 by a liquid feeding pump 79, provide on the rejuvenated ozone solution supply pipe 78. Also, the hydrogen water supply pipe 66 and the rejuvenated hydrogen water supply pipe 76 are connected to each other prior to the cleaning nozzle 54, so that whether to supply fresh or rejuvenated hydrogen water to the cleaning nozzle 54 can be switched by means of a valve 80. Similarly, the ozone water supply pipe 68 and the rejuvenated ozone solution supply pipe 78 are connected prior to the cleaning nozzle 55, so that whether to supply fresh or rejuvenated ozone solution can be switched by means of a valve 81. Note that hydrogen water and ozone water having been filtered by the respective filters 70, 71 are returned to the hydrogen solution producing device 64 or the ozone solution producing device 65 for supplement of hydrogen gas or ozone gas as gas concentration of such rejuvenated hydrogen or ozone water is reduced, though it does not contain particles.

On the flank side of the cleaning section 52, the loader cassette 58 and the unloader cassette 59 are detachably provided. These two cassettes 58, 59 have identical shapes allowing accommodation of a plurality of substrates W. The loader cassette 58 accommodates substrates W yet to be cleaned, while the unloader cassette 59 accommodates cleaned substrates W. A substrate carrying robot 57 is provided between the cleaning section 52 and the loader cassette 58, the unloader cassette 59. The substrate carrying robot 57 has, at the upper part thereof, an arm 82 having an retractable link mechanism. The arm 82, which is provided rotatably and elevatably, supports and carries, by an end thereof, a substrate W.

The thus structured cleaning device 51 operates automatically as operation of the respective components is controlled by a controlling device, except for determination of various cleaning conditions by an operator, such as distances between the cleaning nozzles 54, 55, 56 and a substrate W, moving speeds of the cleaning nozzles, the amount of cleaning solution to be supplied, and so on. Specifically, , when an operator using the cleaning device 51 operates a start switch after setting a substrate w yet to be cleaned on the loader cassette 58, the substrate carrying robot 57 carries the substrate W from the loader cassette 58 to the stage 53, and hydrogen water supersonic cleaning, ozone water supersonic cleaning, rinse cleaning are sequentially, automatically applied using the respective cleaning nozzles 54, 55, 56, on the stage 53. After rinse cleaning, the substrate carrying robot 57 carries the cleaned substrate W to the unloader cassette 59 for accommodation.

A cleaning device 51 of the present invention, which is constructed for cleaning in various cleaning methods, such as hydrogen water supersonic cleaning, ozone water supersonic cleaning, and rinse cleaning, by using three cleaning nozzles 54, 55, 56, allows application of various cleaning methods by using a single device. This enables thorough removal of various objects by removing objects on the surface of the substrate using hydrogen water supersonic cleaning and ozone water supersonic cleaning, and subsequently rinsing the surface of the substrate to wash out the cleaning solution attached thereon. Also, the device of this embodiment, in which hydrogen water solution/ozone water solution producing section 60 is provided and ozone solution producing device 65 is integrally incorporated thereinto, can use ozone water solution before the strength of ozone water is deteriorated, though the life of ozone is rather short. That is, ozone water supersonic cleaning can be applied effectively.

In addition, as a cleaning device 51 of this embodiment comprises a hydrogen solution producing device 64 and an ozone solution producing device 65, which have a short start-up time and a high efficiency in use of gas and deionized water, there can be realized a cleaning device with a high operation rate and high productivity for preferable use in a manufacturing line of various electronic devices (such as semiconductor devices, LCD panels, and similar devices).

It should be noted that the scope of the present invention is not limited to the above described embodiments, and can be applied to various amendments without departing from the gist of the present invention. For example, an ozone producing device, which is described above as one of the components of an ozone water solution producing device, may not be configured as a component of an ozone solution producing device, and ozone may be supplied from any external ozone gas supply source. Also, a structure of a gas dissolving module as a gas dissolving means and that of a buffer as a gas storing means, as well as a valve and a black-flow prevention valve, and so on, may be changed as necessary.

Experiment

The inventors of the present invention carried out an experiment to ascertain that the concentration of the effective components in a gas solution reliably increased rapidly when a gas storing means of the present invention was employed. This experiment will be described in the following.

Figure 12:
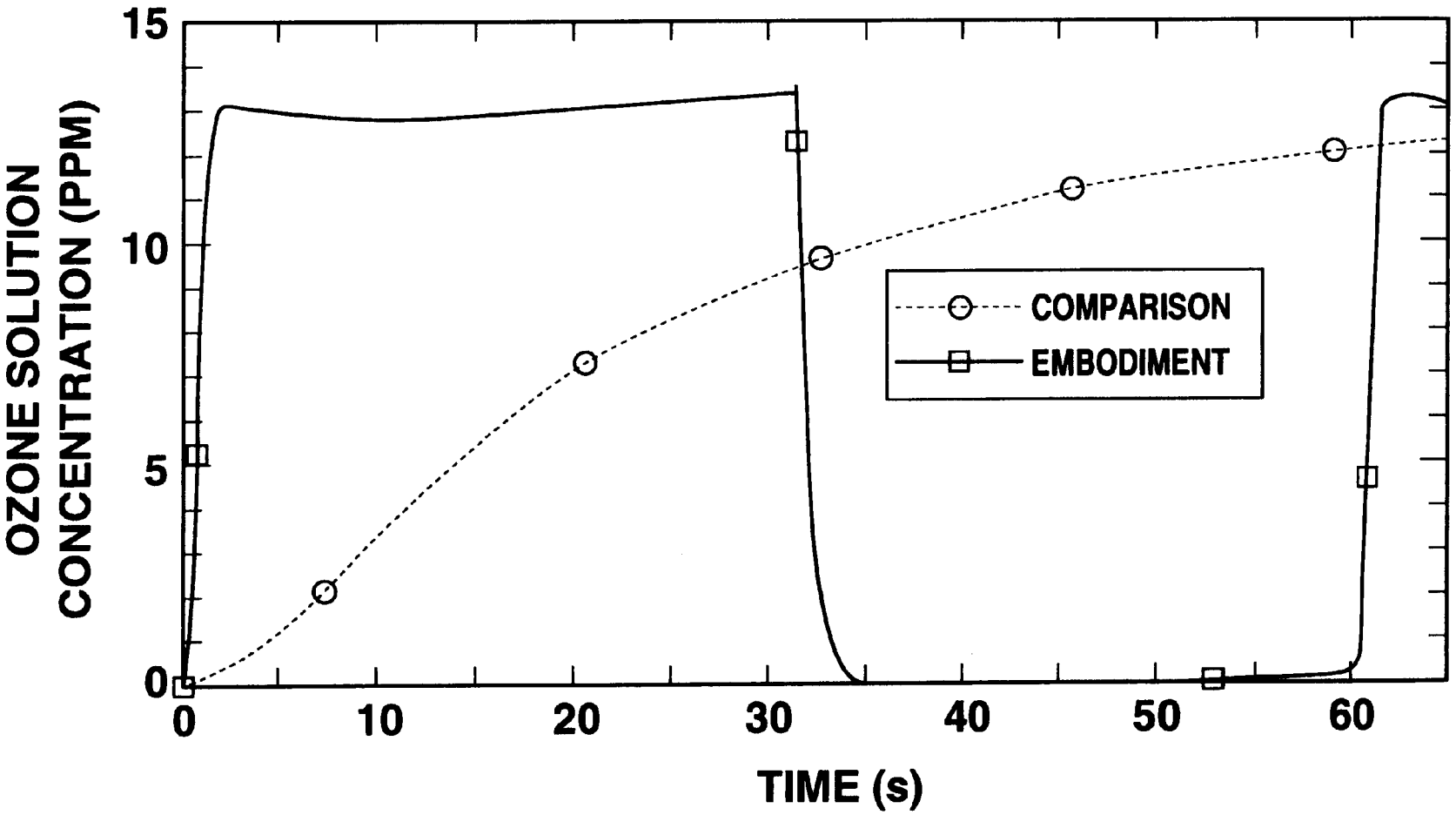
FIG. 12 is a graph comparing start-up proprieties of ozone concentration between ozone solution produced by a conventional ozone producing device and that by an ozone producing device of the present invention.
Figure 13:
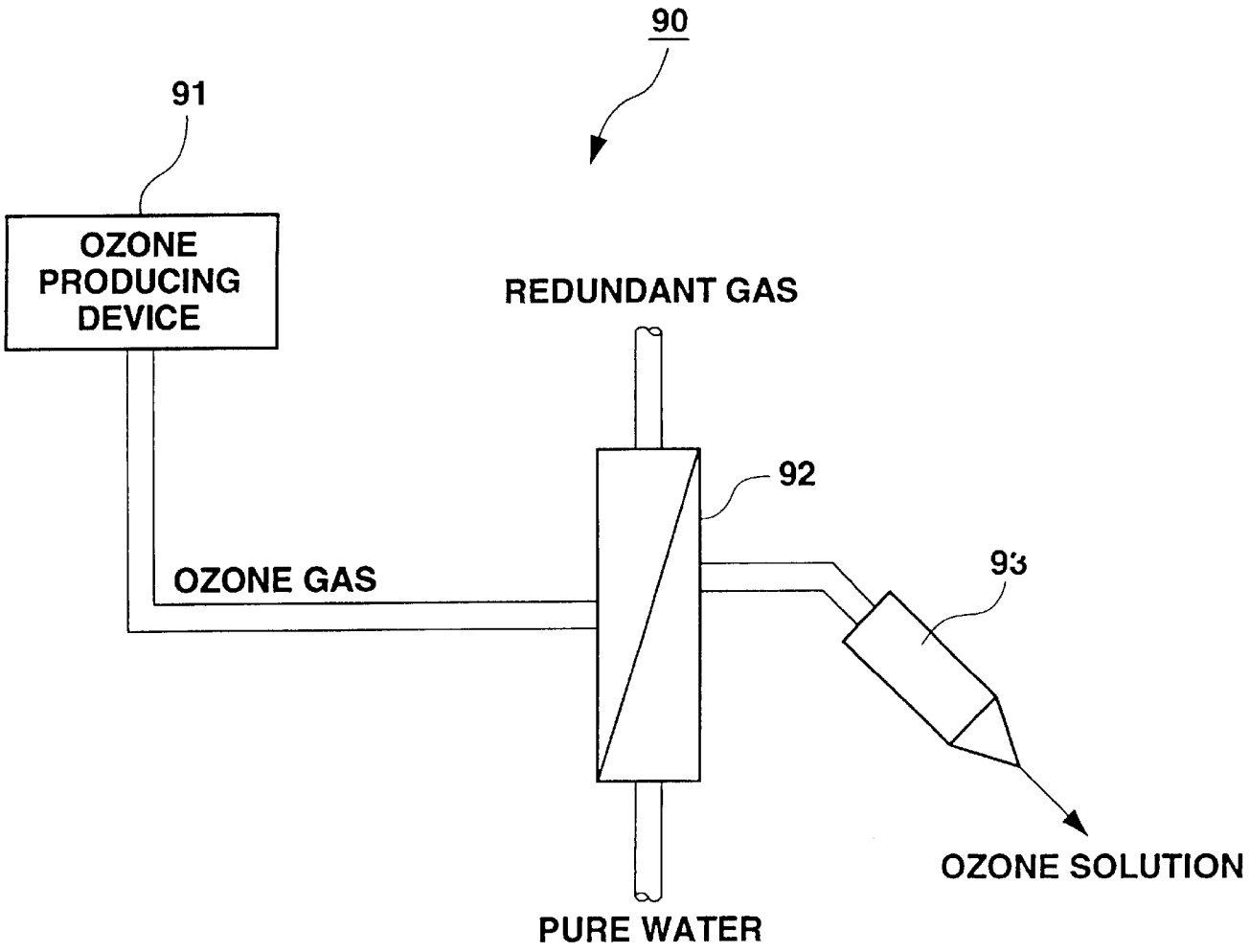
Fig. 13 (PRIOR ART)
FIG. 13 is a diagram showing a schematic structure of a conventional ozone producing device.

In a conventional ozone solution producing device without a buffer (a gas storing means) and an ozone solution producing device with a buffer according to the present invention, ozone gas was dissolved into deionized water using a gas dissolving module, so that change in ozone concentration of the resultant ozone water solution could be checked. In this experiment, the gas capacity of the gas dissolving module in use was 125 cc, the amount of deionized water was 185 cc, the amount of ozone produced was 1 g/hour, ozone gas concentration was about 10% (volume ratio), and the flow rate of the deionized water was 2 liters/min. A syringe of 200 cc was used as a buffer. Ozone gas was driven for discharge by a cylinder pump. Discharge speed was 60 cc/min for the initial one second, and 2.5 cc/min for subsequent 30 seconds. Produced ozone solution was introduced to an ozone concentration meter for measurement of ozone concentration, of which result is shown in FIG. 12. In FIG. 12, the ordinate represents time (seconds), and the abscissa represents ozone concentration (ppm). The broken line indicates the result obtained from a conventional ozone solution producing device, and the solid line indicates the result obtained from an ozone solution producing device of the present invention.

As is obvious from FIG. 12, with the conventional device without a buffer, ozone concentration did not come to be in a normal state even after 60 seconds after the start of supplying ozone. On the other hand, in the case of a device of the present invention, ozone concentration increased quite rapidly as ozone gas was supplied quickly at the start of supplying ozone, coming to be at the maximum value in about one second, and remaining so for about thirty seconds.

As described above, the most significant feature of a device of the present invention is proved, i.e., the use of a buffer enables a quick increase of ozone concentration in a gas dissolving module immediately after the start of supplying gas, and, as a result, the ozone concentration in the resultant ozone solution can be increased quickly.

As described in detail, according to the present invention, gas concentration in a gas dissolving means can be quickly increased, so that a time required until concentration of effective components in the gas solution comes to be at a predetermined value, can be reduced. As a result, a highly efficient gas dissolving producing device with a shorter start-up time and less waste of source gas and solvent can be realized. Also, employment of such a gas solution producing device make possible a cleaning device with a high operation ratio and high productivity, which is preferable for use in a manufacturing line for various electronic devices (LCD panels and so on).

What is claimed is:

1. A gas solution producing device, comprising:

gas dissolving means for receiving gas and solvent as material of gas solution and bringing the gas and the solvent into contact with each other to thereby dissolve the gas into the solvent;

a gas introducing path for introducing the gas from a gas supply source to the gas dissolving means;

gas storing means, provided in the gas introducing path, for temporarily storing the gas, and, after having stored a predetermined amount of gas, for discharging the gas stored to the gas introducing path;

switching means, provided at a connection between the gas introducing path and the gas storing means or a position on the gas introducing path closer to the gas dissolving means than the connection, for switching introduction and suspension of the gas flowing into the gas dissolving means by opening or closing the gas introducing path; and stored gas backflow prevention means, provided at the connection between the gas introducing path and the gas storing means or a position on the gas introducing path closer to the gas supply source, for preventing the gas discharged from the gas storing means from backflowing to the gas supply source side.

2. A gas solution producing device according to claim 1, wherein the gas storing means has a capacity larger than a sum of an amount of gas allowed to remain in the gas dissolving means and an amount of gas allowed to remain in a part of the gas introducing path, this part being a section between the gas dissolving means and the connection between the gas introducing path and the gas storing means.

3. A gas solution producing device according to claim 1, wherein a plurality of the gas storing means are provided on the gas introducing path, further comprising switching control means for controlling the plurality of gas storing means such that, when at least one of the plurality of gas storing means discharges the gas stored therein to the gas introducing path, gas supplied from the gas supply source to other gas storing means is temporarily stored, and the gas stored is not discharged to the gas introducing path.

4. A gas solution producing device according to claim 1, wherein the gas dissolving means dissolves the gas into the solvent by bringing the gas and the solvent into contact to each other via a gas dissolution membrane.

5. A gas solution producing device according to claim 1, wherein the gas storing means includes a gas storing section for storing the gas by enlarging a capacity thereof, and for discharging the gas by reducing the capacity, and a driving mechanism for causing the gas storing section to change the capacity as desired.

6. A gas solution producing device according to claim 1, wherein the gas storing means includes speed changing means for changing a speed at which to discharge the gas stored in the gas storing means, to the gas introducing path.

7. A gas solution producing method using a gas solution producing device according to claim 1, comprising the steps of:

temporarily storing a predetermined amount of gas in the gas storing means while introduction of the gas from the gas supply source to the gas dissolving means is suspended by the switching means closing the gas introducing path;

discharging, thereafter, the gas stored in the gas storing means to the gas dissolving means by opening the gas introducing path by the switching means; and dissolving the gas into the solvent in the gas dissolving means by bringing the gas and the solvent into contact with each other.

8. A gas solution producing device using a gas solution producing device according to claim 3, comprising the steps of:

temporarily storing a predetermined amount of gas in at least one of the plurality of gas storing means while introduction of the gas from the gas supply source to the gas dissolving means is suspended by the switching means closing the gas introducing path;

opening the gas introducing path by the switching means;

repeating, under control by the switching control means and while desirably selecting gas storing means, operation of discharging the gas stored in at least one of the plurality of gas storing means to the gas dissolving means, while storing a redetermined amount of gas in at least one of the other gas storing means; and dissolving the gas into the solvent in the gas dissolving means by bringing the gas and the solvent into contact with each other.

9. A gas solution producing device according to claim 7, wherein the gas in the gas storing means is discharged to the gas dissolving means following at least two steps, including first discharge of the gas stored to the gas dissolving means at a predetermined speed, and second discharge of the gas stored to the gas dissolving means at a speed slower than the speed in the first discharge.

10. A gas solution producing device according to claim 8, wherein the gas in the gas storing means is discharged to the gas dissolving means following at least two steps, including first discharge of the gas stored to the gas dissolving means at a predetermined speed, and second discharge of the gas stored to the gas dissolving means at a speed slower than the speed in the first discharge.

11. A cleaning device, having a gas solution producing device according to claim 1.

12. A cleaning device, having a gas solution producing device according to claim 3.

* * * * *